United States Patent [19]

Nahta

[11] 4,208,485

[45] Jun. 17, 1980

[54] FOAMING COMPOSITION FOR TEXTILE FINISHING AND COATINGS

[75] Inventor: Roop C. Nahta, Charlotte, N.C.

[73] Assignee: GAF Corporation, New York, N.Y.

[21] Appl. No.: 21,564

[22] Filed: Mar. 16, 1979

Related U.S. Application Data

[63] Continuation of Ser. No. 897,378, Apr. 18, 1978.

[51] Int. Cl.[2] ..... C08J 9/30

[52] U.S. Cl. ..... 521/65; 521/66; 521/67; 521/69; 521/70; 521/71; 521/74; 521/84; 521/85; 521/88; 521/89; 521/95; 521/107; 521/109; 521/114; 521/121; 521/125; 521/145; 521/147; 521/148; 521/178; 521/187; 521/188

[58] Field of Search ..... 521/65–71, 521/74

[56] References Cited

U.S. PATENT DOCUMENTS

| | | | |
|---|---|---|---|
| 2,861,963 | 11/1958 | Butsch | 521/74 |
| 3,032,516 | 5/1962 | Burchord et al. | 521/69 |
| 3,823,104 | 7/1974 | Bondy et al. | 521/65 |
| 4,102,808 | 7/1978 | Stroka | 521/65 |

*Primary Examiner*—Morton Foelak

*Attorney, Agent, or Firm*—Walter C. Kehm; Marilyn J. Maue

[57] ABSTRACT

An expansion agent comprising a foamable mixture of (a) 15–53 weight % of a foaming agent having 6 to 78 carbon atoms selected from the group of an ammonium salt, aliphatic amine salt and/or an alkali metal salt of an alkyl sulfate, hydroxyalkyl sulfate, alkyl ether sulfate and/or aryl alkyl ether sulfate; (b) 5–42 weight % of a dispersant having 22 to 260 carbon atoms selected from the group of an alkyl alkyleneoxy amine and/or its quaternary alkylsulfate, alkylhalide or alkylphosphate derivative; and (c) 5–40 weight % of a stabilizer having 8 to 68 carbon atoms selected from the group of a sodium and/or potassium salt of an alkyl sulfosuccinate; and the combination of said mixture with a synthetic resin, latex or natural rubber to provide a coating or finishing composition; the process of applying said composition to a substrate and the treated substrate product having incorporated the composition of the invention.

17 Claims, No Drawings

FOAMING COMPOSITION FOR TEXTILE FINISHING AND COATINGS

This is a continuation of application Ser. No. 897,378, filed Apr. 18, 1978.

The finishing of textiles to increase fiber strength, resistance to napping or abrasion, flame retardance, soft hand, flexibility and other desireable properties has been effected by applying a coating or finishing agent, e.g., a resin, latex or uncured plastic, capable of imparting one or more of the above properties to the textile, which after impregnation, drying and/or curing imparts the desired characteristics to the finished product.

For uniform distribution and textile penetrability, the resin or coating substance is usually dissolved or suspended, i.e., "expanded", in water to provide an aqueous solution which can easily be applied to the textile in the required dosage and diluted concentration. Although the products resulting from the application of such aqueous expansion to a substrate are satisfactory in several respects, the process of coating or finishing encounters many difficulties.

Primarily, to arrive at the finished or coated product, the aqueous "add-on" layer of coating substance requires extensive drying periods, sometimes leading to distortion of the fibers. The cost of driving off large volumes of water and the time consumed in drying the treated substrate greatly increases the cost of the operation. Also, certain chemicals used in the pretreatment of textiles, e.g. dyes, pigments, fixing agents, scouring agents, etc. which are often toxic or corrosive, are vaporized at the required drying temperature and are entrained with the steam generated from the finishing or coating solution during the drying or curing operation. The release of such contaminating substances is a serious source of air pollution. A further disadvantage encountered with aqueous expansion solutions coated on a substrate is extreme difficulty in the thickness build-up of the applied layer. Conversely, in the case where only the thinest film of a finishing substance is applied to a textile, the aqeuous layer may lose uniformity of the resin distributed on the textile.

The present invention overcomes the above disadvantages by substantially eliminating water as an expansion agent, by avoiding extensive evaporation time and temperature with attendant entrainment of toxic or corrosive materials, by conserving heat energy required for extended drying time and by permitting application of a controlled film thickness with improved resin distribution and penetration into the fibers of a woven or knitted fabric. These advantages are set forth as objects of the present invention, together with the objectives of providing a commercially feasible and more economical process for finishing textiles or for coating a substrate and for producing an improved product of manufacture having a continuous coating of a uniformly distributed additive, such as a resin, deposited as a surface film over/or incorporated in the interstices of a woven or knitted fabric.

These and other objects, improvements and advantages of the present invention will become apparent from the following description and disclosure.

According to the present invention there is provided an improved expansion agent substantially comprising a foamable mixture of (a) 15–53 weight % foaming agent having 6 to 78 carbon atoms, selected from the group of an ammonium-, amino- and/or alkali metal- salt of an organic sulfate having the formulae:

$$R-(OCH_2CH_2)_nOSO_3H^-M^+ \quad \text{I.}$$

and/or $$R^1-(CH_2CH_2O)_{n+1}SO_3H^-M^+ \quad \text{II.}$$

wherein R is alkyl or hydroxyalkyl, both of 6 to 18 carbon atoms; $R^1$ is hydrogen, alkyl of 6 to 18 carbon atoms or phenoxy substituted with not more than two alkyl groups each having 1 to 23 carbon atoms; n is an integer having a value of 0 to 10; and M is sodium, potassium, calcium, ammonium or an alkyl- or alkyloxy-amine moiety of from 1 to 6 carbon atoms; (b) 5–42 weight % of a dispersant having 22 to 260 carbon atoms selected from the group of an alkyl-alkyleneoxy amine and/or the corresponding quaternary derivative thereof, having the formulae:

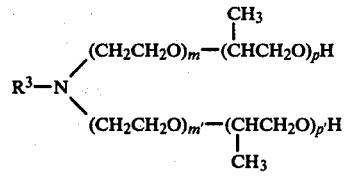

III.

AND/OR

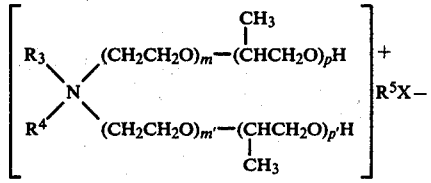

IV.

wherein $R^3$ is alkyl of 6 to 20 carbon atoms; $R^4$ and $R^5$ are independently alkyl of 1 to 4 carbon atoms; X is sulfate, halide or phosphate; m and m' are integers independently having a value of 4 to 30 and p and p' are integers independently having a value of 0 to 20; and (c) 5–45 weight % of a stabilizer having 8 to 68 carbon atoms selected from the group of the sodium and/or potassium salt of an alkylsulfo-succinate, having the formula:

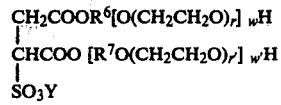

V.

wherein $R^6$ and $R^7$ are independently alkylene of 4 to 22 carbon atoms; r and r' are independently integers each having a value of 0 to 15; w and w' are independently integers each having a value of 0 or 1; and Y is sodium or potassium.

Preferably, the above foamable mixtures of (a), (b) and (c) comprise about 100% of a mixture of 30–50 weight % foaming agent, 12–30 weight % dispersant and 20–45 weight % stabilizer. The most preferred mixtures consist essentially 36–45 weight % (a), 15–30 weight % (b) and 22–45 weight % (c).

Representative examples of the above component (a) include sodium lauryl sulfate; potassium cetyl sulfate; the ammonium salt of a $C_{12}$ to $C_{15}$ alkanol sulfate containing ethyleneoxide (Neodol 25-3A, supplied by Shell Chemical Co.); ammonium ethoxy sulfate; ammonium polyethyleneoxy sulfate; ammonium decylphenoxy-poly(ethyleneoxy) sulfate (Alipal CO-436, supplied by GAF Corporation); ammonium nonylphenoxy-poly(ethyleneoxy) sulfate (Alipal CD-128, supplied by GAF Corporation); the ammonium salt of a $C_{11}$ to $C_{15}$ secondary alkanol sulfate containing ethyleneoxide (Tergitol 15S-3A, supplied by Union Carbide Corp.); calcium 2,4-didodecylphenoxy-poly(ethyleneoxy) sulfate; the sodium salt of 2-ethyl-2-methyl-4-undecanol sulfate (Tergitol anionic 4, supplied by Union Carbide Corp.); ammonium dinonylphenoxy-poly(ethyleneoxy) sulfate; the sodium salt of 2-ethyl-hexanol sulfate (Tergitol anionic 08, supplied by Union Carbide Corp.); the ethylamine salt of pentadecyl-poly(ethyleneoxy)sulfate; the butyl-amine salt of dodecylpolyoxyethylene sulfate; the ethoxyamine salt of octylpolyoxyethylene sulfate; the hexylamine salt of nonylphenoxypolyethyleneoxy sulfate; etc. and the corresponding alkali metal, ammonium and amine salts, where the prefix "poly" designates from 2 to 10 units.

Illustrative of the above component (b) are octyl-poly(ethylene-isopropyleneoxy)amine, decyl-polyethyleneoxy amine, quaternary nonyl-poly(ethyleneoxy-isopropyleneoxy) propylamine sulfate, quaternary decyl-polyethyleneoxymethylamine halide, preferably the bromide or chloride salt, etc., and the corresponding sulfates, halides or phosphates where the prefix "poly" designates 4 to 50 units.

Exemplary of the above component (c) are sodium decylsulfosuccinate, sodium octadecylsulfosuccinate, sodium methyl-tris-(ethyleneoxy)-hexylsulfosuccinate, sodium dioctadecylsulfosuccinate, sodium dinonylsulfosuccinate, sodium nonyl-butyl-sulfosuccinate, sodium dioctylsulfosuccinate, sodium dibutylsulfosuccinate, sodium eicosylsulfosuccinate, the corresponding potassium salts, etc.

Preferred of the above components of the foamable expansion mixture are the compounds of (a) wherein R is alkyl of 9 to 14 carbon atoms, n has a value not greater than 4, $R^1$ or $R^2$ is alkyl of 8 to 12 carbon atoms and M is sodium or ammonium, of which sodium lauryl sulfate and the commercial products Alipal CO 436, and Alipal CD 128 (supplied by GAF Corporation) are most preferred; the compounds of (b) wherein $R^3$ is alkyl of 8 to 16 carbon atoms, m and m' have a value of 6 to 18 and p and p' have a value of 0 to 12, of which the commercial products Antaron PC 37 and Gafstat S-100 (supplied by GAF Corp.) are most preferred; and the compounds of (c) wherein $R^6$ is alkyl of 6 to 16 carbon atoms and X is sodium, of which Duowet EHS and Nekal WT 27 (both supplied by GAF Corp.), and Aerosol 18 (supplied by American Cynamid) are most preferred.

The foamable mixture of the present invention is prepared by mixing components (a), (b) and (c) for a period of from 5 minutes to 1 hour or until a uniform mixture is obtained under atmospheric pressure and at a temperature of from about room temperature to 80° F. or below the flash point of any alcohol, such as methanol, ethanol, n-propanol or isopropanol, which may be added to the formulation in an amount of between about 0.01 and about 0.2 parts per part of water, for the purpose of stabilizing the subsequently formed foamable mixture/resin composition.

The resins or elastomers which are combined with the above foamable expansion mixture prior to foaming include the melamine/formaldehyde resins, e.g. the resins marketed as CYMEL 303 (50% solids) and AEROTEX M-3 (80% solids), both supplied by American Cyanamide Company; urea/formaldehyde resin, marketed as PERMAFRESH 479 (36% solids) and PERMAFRESH 183 (42% solids) by Sun Chemical Co.; the resins of formaldehyde/guanamine; formaldehyde/acetoguanamine; formaldehyde/benzoguanamine; glyoxal, marketed as PERMAFRESH 114 (42% solids); imidazolidone marketed as PERMAFRESH 184 (42% solids); vinylchloride polymers, and vinylchloride/acrylic copolymer latexes marketed as GEON* 460X2, 460X1, 460X6, 460X9, 576, 351, 352, etc. (48–60% solids); acrylic and nitrile latexes, marketed as HYCAR* 2600X138, 2600X223, 1570X60, 2600X178, 1572X45, 2679, etc. (40–50% solids); styrene/butadiene copolymer; acrylonitrile/butadiene/styrene terpolymers; the condensation products of aminotriazine and diepoxide, e.g. ARALDITE RD-2 from Ciba-Giegy Co. and EPONITE 100 from Shell Chemical Co.; a sizing agent for polyester yarns having a specific gravity, 25/25° C. of 1.508 a pH of 6–8 and a viscosity 24° C. of 35 cp, marketed as WD Size, by Eastman Chemical Co; neoprene; chloroprene; chloroprene/methacrylic acid copolymer; vinylidine chloride/vinylchloride copolymer; vinyl chloride homopolymer; urethane latexes; alkyl acrylate/acrylonitrile copolymer; the textile finishing resins discussed on pages 145–153, 236–255 of Textile Finishing by A. J. Hall (1966); natural rubber or any polymerizable combination of the above monomers suitable to produce resins, latexes or elastomers, referred to herein as coating agents, which impart beneficial characteristics to a textile as a finish or coating or to other substrates on which they are coated.

* supplied by B. F. Goodrich Chemical Company

The coating agent, or an aqueous or alcoholic solution of the same is combined with the foamable mixture and an acid catalyst, or a catalyst which acts as an acid donor to form the composition of foamable mixture and coating agent. Suitable catalysts include magnesium chloride; zinc nitrate; zinc fluoborate; an acid salt of a weak base, e.g. ammonium chloride, morpholine hydrochloride, oxalic acid; diammonium phosphate; ammonium sulfate; alkanalomine hydrochloride; and mixtures thereof, e.g. KNIGHTSET M-4, which is a mixture of zinc nitrate and magnesium chloride. In addition to their catalytic function in aiding fixation of the resin or elastomer to a fabric, certain acidic catalytic agents directly contribute to improving the qualities of the substrate. For example, ammonium sulfate provides high crease resistance to a textile coated with urea/formaldehyde resin and alkanalomine hydrochloride is similarily beneficial for modified melamine/formaldehyde coatings.

The catalyst is generally present in the composition in an amount between about 2 and about 20 parts by weight, preferably between about 5 and about 15 parts by weight, per 100 parts of coating agent. The composition also contains between about 4 and about 40 parts by weight, preferably about 8 to about 25 parts by weight, of the foamable mixture per 100 parts of coating agent and between about 30 and about 80 parts by weight diluent per 100 parts of coating agent. Suitable diluents for the present compositions include water or a dilute alcoholic solution of from about 0.01% to about 5% concentration of a $C_1$ to $C_3$ alkanol. When a high solids resin is employed, e.g. AEROTEX M-3 of 80% solids, it is recommended that at least 60 parts by weight, preferably between about 65 and about 35 parts by weight diluent per 100 parts of coating agent be present in the composition. The water or aqueous component may be mixed with the coating agent during or prior to combining with the foamable mixture or it may be present in the foamable mixture prior to mixing with the coating agent. However, it has been found beneficial to include a portion of water in both the coating agent and the foamable mixture prior to combining. In this way a better dispersion of the respective components is obtained.

Either or both of the foamable mixture or the coating agent may additionally contain 0.5 up to 25 parts of other additives which contribute desirable properties for particular needs. Thus, there may be added a softener, such as a non-ionic polyethylene emulsion, e.g. PEEM 410 or GAFSOFT (supplied by GAF Corporation); a fatty acid derivative of aminoethyl ethanolamine, quaternized for example with dimethylsulfate, diethylsulfate or triethylphosphate; a fatty acid such as stearic, behenic or tallow acid; etc. and other known non-ionic softeners. A foam booster such as ammonium stearate or a conventional flame retardant chemical, e.g. antimony trioxide, tris(2,3-dibromopropyl) phosphate, or tetrakis-(hydroxymethyl) phosphonium chloride, may also be added to the composition. Additionally, known pigments and dyes can be incorporated in the composition. Examples of pigments include organic and inorganic types, such as NYTAL 300, supplied by R. T. Vanderbilt Company; TIPANOX R-960 and RA-50, both supplied by Titanium Pigment Corporation; iron oxides; cadmium reds; copper ferrocyanide; red lead; chrome yellow, orange and green; molybdate orange; chrome oxides; zinc yellow; zinc oxides; ultramarine blue; manganese dioxide; molybdenum sulfate; antimony trioxide; titanium dioxide; metallic pigments such as aluminum, copper, bronze, gold, etc.; toluidine red; lithol red; o-nitraniline orange; pigment lakes; phosphotungstic green; phosphomolybdic green; phthalocyanines; indanthrones etc. Suitable dyes which may be employed include any of the basic, disperse, acid, direct, azoic or azo dyes including the cyanine, anthraquinone, indole, e.g., those covered in U.S. Pat. Nos. 3,497,527, 3,113,825, 3,013,015, 3,073,820, etc., azine, azo, cyanine, indigoid, pyrrole, quinoline, stilbene, thiazole, and anthraquinone dyes or pigments. In this way a textile can be colored simultaneously with finishing, as in a slash dying operation.

Along with dyes or pigments, it may also be desirable to employ conventional amounts, with respect to colorant, of brightners and UV absorbers, e.g. TINTOFEN, a stilbene derivative supplied by GAF Corporation and UVINUL, a hydroxy biphenyl methane, and/or a leveling agent, e.g. GAFTEX DN-159 or COM-154, a polyether, all supplied by GAF Corporation. When coloring agents are included, they are generally present in an amount between about 0.2 to about 5 parts by weight of the total composition.

The present composition may also include an additional and specialized resin stabilizer such as a $C_1$ to $C_4$ alkanol or a glycol; a vinyl stabilizer, such as ADBAS-TAB BC-110 (supplied by Carlisle Chemical Works); or ammonium stearate, which is particularly beneficial for latex type resins. Other stabilizer additives include cadmium-zinc complexes; zinc complexes; dibasic lead phthalate; guargum and vinyl ethers which promote stabilization of vinyl type resins.

Wetting agents, such as a fatty acid derivative of the type exemplified by alkylolamide; a polyamide; a alkylolamine or a sulfonated amine condensate thereof, commercially available as NOPCOGEN; an aliphatic ester sulfonate, such as GAFTEX 288 and other conventionally employed types of wetting agents, can be incorporated in the present composition. Conventional water repellant agents can also be included in the compositions of this invention, e.g. FIRE RETARDANT RCA.

Still further, additional dispersing agents, such as a sodium salt of a condensed naphthalene sulfonic acid, marketed as NOPCOSANT L (supplied by Nopco Chemical Corporation); an anionic polymer marketed as TAMOL 850 (supplied by Rohm and Haas Company); an anionic fatty alcohol sulfate and fatty alcohol ethyloxylate sulfate or an alcohol sulfate and alcohol ethoxylate sulfate, marketed as SIPON LSB, SIPEX SB or SB 8208 (supplied by Alcolac Chemical Corp.); the sodium salt of an allyl naphthalene sulfonate; etc. can be added to the present composition. In cases where it is desirable to form a heavy plastic coat on a solid substrate, e.g. a plastic sheet, certain plasticisers, such as monomeric MONOPLEX S-73 (supplied by Rohm and Haas Company); KRONITEX 100, a phosphate supplied by F. M. C. Corporation; PARAPLEX G-62, an epoxy compound, supplied by Rohm and Haas Company; SANITICIZER 141 or 148, a phosphate supplied by Monsanto Company; and other dialkyl phthalates or glycerol monooleates, as well as linear alcohol phosphates, sulfates or sulfonated esters of ethylene oxides; sodium, ammonium or potassium salts of $C_3$ to $C_{12}$ alkyl ester sulfates, e.g. dodecylbenzene sulfonate, propyl oleate sulfate or castor oil sulfate; etc. can be usefully employed in the composition.

Additionally anti-tac agents or anti-static agents of the anionic or non-ionic type such as phosphates, sulfates or sulfonated esters, the quaternary ammonium derivative of a complex phosphate ester, e.g. marketed as GAFSTAT or GAFTEX, supplied by GAF Corporation; ALWAX 253A, a crystalline paraffin wax, supplied by American Cyanamide Co.; etc. may also be included.

In cases where it is desirable to polymerize a resin after application to the substrate, a buffer or pH adjuster can be employed to maintain the pH at the level most beneficial to promote such polymerization. Ammonium hydroxide has been used for this purpose, although other pH adjusters such as sodium hypophosphate, ammonium phosphate, dicyandiamide, etc. can also be employed without detriment to the composition.

During, or after forming the composition, a thickner can be added to adjust the viscosity of the composition and to provide a more rigid foam, when such is desired. Such thickners include any of the conventional types, e.g. those marketed as NOPCOSIZE, a polyacrylic size for nylon filament, (supplied by Nopco Chemical Co.); Huber Clay #40C from J. M. Huber Corporation; guar gum; a vinyl ether; GANTREZ, Thickener L, or Thickener LN, (polymethyl vinyl ether/maleic anhydride copolymers, supplied by GAF Corporation); GUALAXY 1074, a guar gum mixture; ACRYSOL ASE 60, supplied by Rohm & Haas Co.; CELLOSIZE QP 52,000, supplied by Union Carbide Corporation; GOOD-RITE K-718, from B. F. Goodrich Chemical Co.; METHOCEL 90 HG, a methyl cellulose, from Dow Chemical Co.; PARGUM 128, from Para-Chem, Inc.; CATALPO clay, from Freeport Kaolin Co.;

Foam Fil 2-135, a talc from International Talc Co.; etc. Additional strength and foam resiliency is achieved with low solids latexes by providing a heat-sensitized foam. Heat-sensitization is a technique that gels the wet latex foam early in the drying stage to preserve a better cell structure during further drying and curing. The foam composition resulting from this treatment would have an approximate viscosity of between 1,000 and 5,000 cp or more. Also, for this purpose, a heat sensitizing agent, such as, for example, tartaric acid, or COAGULANT WS, supplied by Naftone, Inc., may be added to the composition prior to or during the foaming operation, if desired. The heat sensitized foam is beneficially formed by foaming the composition to between about a 7–12:1 ratio of air to solids and then reducing the speed of the mixer within the last 5–60 seconds of mixing so as to slowly fold in the foam. Exemplary of such a heat sensitizing compositions are the following:

Heat-Sensitized Nitrile Foam Compound

| Material | Parts Dry Weight |
|---|---|
| Foam Mix. of 30% (a), 20% (b), 25% (c) + 50% by volume $H_2O$ | 30 |
| Hycar 1570X60 | 100.0 |
| Zinc Oxide | 3.0 |
| Butyl zimate | 1.0 |
| Nytal 300 | 30.0 |
| Coagulant WS | 1.0 |
| Good-rite K-718 | 0.5 |

Heat-Sensitized Acrylic Latex Foam Formula

| Material | Parts Dry Weight |
|---|---|
| Foam Aid of 30% (a), 20% (b), 25% (c) + 50% by volume $H_2O$ | 25 |
| Hycar 2600X178 | 100 |
| Alwax 235A | 10 |
| Hydrasperse clay | 16 |
| Titanox RA-50 | 4 |
| Tartaric acid | 3 |

To increase the solids content of the composition, and to reduce stickiness of the resulting foam, any of the conventional solid pigments and/or tac reducers, preferably zinc oxide or a commercial size, e.g. ALWAX supplied by American Cyanamide Company and/or a hydrous aluminum silicate such as HYDRASPERSE clay, supplied by J. M. Huber Corporation, can also be incorporated in the composition.

Expansion or foaming of the coating agent in any of the above indicated compositions, takes place under conditions of from room temperature to below the polymerization temperature of the resin and under atmospheric pressure although, it is to be understood that reduced pressure or pressures in excess of atmospheric, e.g. up to 100 psig can be employed if desired. While the preferred expansion agent is air, other gaseous materials such as nitrogen, oxygen, ammonia, an oxide of carbon, etc. may also be employed to provide the desired foam. Any of the conventional mixing, foaming or frothing devices can be employed, for example, a Hamilton Beach milk shaker, a Hobart mixer, a Lightning mixture mixture, an Oakes foamer, etc. are recommended as suitable for this purpose. The minimum initial mixing speed is preferably that at which vortexing occurs whereupon small cell size foams are provided. Specifically, mixer speeds of between about 1,000 to about 3,000 rpm have been successfully employed, although, toward the finish of the foaming operation, it may be desireable to employ a slower mixing speed, so as to refine the cell structure and obtain smaller air bubbles.

Generally, the volume ratio of water to air in the foamed composition of the present invention can vary between about 1:5 and about 1:20, preferably between about 1:8 and about 1:15, depending upon the thickness and stability of the coating or add-on layer or film desired. The expansion or foaming operation is completed within about 2 to about 30 minutes, although a foam time in excess of 10 minutes is usually not required. Utilization of the present gas expansion method with instant foamable mixtures results in a resin volume increase of between about 200% and about 1,000% for foaming and between about 50% and about 200% for frothing. In the most preferred examples of the present invention, the volume increase is between about 400% and about 700%. Other desireable properties which can be achieved with the foams of the present invention include a wet foam density of between about 10 to about 30 lbs/ft.; a solids content between about 10 and about 60 wt. %; a Brookfield viscosity of from about 500 to about 40,000 cp and a final pH between 7 and 11. It is required that the foams of the present invention are frothy and not rigid and that they retain 0% drainage for at least 2 minutes standing at room temperature. If drainage occurs before 2 minutes, the foamed composition may be thickened with one or more of the above thickners and refoamed on the mixer to achieve the frothy stable composition desired.

The resulting foam is suitable for application to a substrate, which application is effected by conventional means such as knife coating, roll coating, spray gun application or pressurizing through a paded fabric, for example, as described in U.S. Pat. No. 4,009,002. The coating may be applied to one or both sides of the substrate according to the specifications of the particular product. For example, sheeting materials used in building or construction can be coated on both sides by laying the sheet on a layer of foam and then applying foam to the exposed upper surface, or the sheet can be passed through a bed of foam maintained in a coating chamber. It is also to be understood that a single coating or a plurality of coats may be applied to the substrate with intermittant drying between coats. The thickness of each foam application can vary between 1 mil and 1.5 inches. In the finishing of a fabric to improve hand and fiber strength, where it is desireable to achieve minimum surface add-on and maximum penetration into the fabric, the initial coat thickness is beneficially less than 0.5 inch and most beneficially provides a film up to about 25 mils thickness. Alternatively, when a coating is required and, where less penetration and a relatively thick surface layer is desired, the thickness of the foam application is generally up to about 1.5 inch, e.g. 0.5 to 1.5 inch, or more per coating operation.

Substrates suitable for coating with the foamed resins of the present invention include rigid or flexible substrates such as yarns and woven, webed, felted, flocked or knited fabrics of which natural fibers such as cotton, wool, silk and linen are examples; and synthetics, e.g. cellulose fibers of which viscose, cellulose acetate or triacetate and alginates are examples; protein fibers, e.g.

FIBROLANE containing glycine and alanine; polyamides; polyesters; acrylics; polyvinylchloride; polyvinylalcohols, e.g. VINYLON; polyvinylidene; dinitriles, e.g. DARVAN; fluorinated polyethylenes, e.g. TEFLON and KELEX CTF; polyolefins, e.g. ZOURLENE and MERAKLON; and other yarns or fabrics. Additional suitable substrates include paper, sheet metal, e.g. steel, polyurethane foam, metalized polyester, glass, rubber, wood, leather, and plastics. The substrate selected for the coating process of the present invention is prepared by cleaning said substrate so as to remove sizes, gums, softeners and other extraneous materials from the coatable surface of the substrate. Conventional techniques are applied for this purpose and include desizing, scouring, bleaching, dyeing, fixation and etching.

The cleaned substrate is then placed on a device for coating with the foamed composition of the present invention which foam is applied to a surface of the substrate by any conventional means including the means enumerated above. The foam layer or film is deposited generally at a rate of between about 5 and about 70 meters of substrate per minute. The treated substrate is then passed to a drier wherein, at a temperature of between about 175° F. and 395° F. the treated substrate is dried and/or cured. When the substrate is a fabric, textile or yarn, the foam layer or film is preferably crushed for additional penetration into the fabric before drying.

When heat sensitization of an acrylic or latex foam is prepared, the substrate is dried for a period of 5 to 20 minutes at 200°–250° F. or until gellation occurs. The drying operation is then finished in an oven at between about 175° F. and about 195° F.

Previously the application of a polymeric resin to a textile for finishing was carried out by expanding the resin in water and pouring the liquid over the textile material passing through the treating device. In such cases, expansion of the resin required extensive use of water, i.e. between 10 and 20 times the weight of the resin. The drying time of such water expanded resin was significantly extended, requiring several hours to obtain a dried and/or cured product. In contrast, the present finishing and coating operations which employ the gas expanded resin, have succeded in greatly reducing drying and curing time to between about 30 seconds to 60 minutes, and is more often effected within a period of 30 seconds to 30 minutes.

The treated substrate of the finished product generally contains from 0.1 to 35% by weight solids of the add-on composition per weight of fabric, preferably between about 2 and about 20 wt %, most preferably between about 5 and about 10 wt % solids of the add-on composition per weight of fabric. On the other hand, the treated substrate product from a coating operation contains an "add-on" layer of between 0.25 and about 10 ounces per square yard of fabric or other substrate.

The process of the present invention which utilizes a gas expanded resin application to a fabric, followed by crushing the foam into the fabric, preferably between rollers under a pressure of from 20 to 70 psig to reduce the coating layer to 5 to 20% of its original thickness, is particularly beneficial for finishing fabrics since this technique allows for minimal surface deposition of resin films, controlled thickness of coatings, faster and more uniform penetration into the fabric and greatly reduces the drying time normally required in a finishing operation. The finished textile fibers are intimately and uniformly impregnated with the resin finishing agent.

Having generally described the present invention, reference is now had to the accompanying examples which illustrate specific and preferred embodiments of the invention; however, such examples are not to be construed as unduly limiting to the scope of the invention as set forth hereinabove and in the appended claims.

All amounts and proportions referred to in the following examples are by weight unless otherwise indicated.

EXAMPLES 1 THROUGH 18

The following foamable mixtures are prepared in graduated glass beakers by mixing the ingredients indicated in parts by weight in the following Table I. Each of the mixtures is stirred at 65°–75° F. for a period of 10 minutes whereupon a uniform formulation is obtained.

TABLE I

| | FOAMABLE MIXTURE FORMULATIONS | | | | | | | | | | | | | | | | | |
|---|---|---|---|---|---|---|---|---|---|---|---|---|---|---|---|---|---|---|
| EXAMPLE | 1 | 2 | 3 | 4 | 5 | 6 | 7 | 8 | 9 | 10 | 11 | 12 | 13 | 14 | 15 | 16 | 17 | 18 |
| Foaming Agent | | | | | | | | | | | | | | | | | | |
| Sodium lauryl sulfate | — | 16 | 19 | — | — | 19 | 25 | 5 | 10 | 20 | 14 | 19 | 16 | — | 16 | 20 | 20 | 20 |
| Ammonium lauryl sulfate | 17 | — | — | 12 | — | — | — | — | — | — | — | — | — | — | — | — | — | — |
| Alipal CO-436 | 10 | 10 | 10 | — | — | 10 | — | — | — | — | 14 | 10 | 10 | 2 | 10 | — | — | 10 |
| Alipal CD-128 | — | — | — | — | — | — | — | — | — | 10 | — | — | — | 2 | — | 10 | 10 | — |
| Tergitol anionic 4 | — | — | — | 15 | 24 | — | — | — | — | — | — | — | — | — | — | — | — | — |
| Tergitol anionic 08 | — | — | — | — | — | — | — | 20 | — | — | — | — | — | — | — | — | — | — |
| Neodol 25-3A | — | — | — | — | — | — | — | — | 16 | — | — | — | — | — | — | — | — | — |
| Tergitol 15S-13A | — | — | — | — | — | — | — | — | — | — | — | — | — | 18 | — | — | — | — |
| Igepon TK-32 | — | — | — | — | — | — | — | — | — | — | — | — | — | — | — | 5 | 5 | — |
| Igepon TC-42 | — | — | — | — | — | — | — | — | — | — | — | — | — | — | — | 5 | 5 | — |
| Emulphogene DA-630 | — | — | — | — | — | — | — | — | — | — | — | — | — | — | — | — | 10 | — |
| Stabilizer | | | | | | | | | | | | | | | | | | |
| Aerosol 18 | 10 | 12 | 8 | 12 | 18 | 8 | 5 | — | 20 | 15 | 8 | 8 | 12 | — | 12 | 5 | 5 | 15 |
| Nekal WT-27 | — | — | — | 12 | — | — | 13 | 12 | — | 15 | — | — | — | 10 | — | — | — | 15 |
| Duowet EHS conc. | 10 | 12 | 8 | — | — | 8 | — | 12 | 5 | — | 8 | 8 | 12 | 12 | 12 | 5 | 5 | — |
| Dispersant | | | | | | | | | | | | | | | | | | |
| Antaron PC-37 | 12 | 10 | 15 | — | — | — | 5 | 15 | 15 | 4 | 15 | — | 10 | 15 | 10 | — | — | — |
| Gafstat S-100 | — | — | — | 8 | 10 | 15 | 10 | 5 | — | 12 | — | 15 | — | 5 | — | 10 | — | — |
| Alipal CO-436 | — | — | — | 8 | 8 | — | — | — | 5 | — | — | — | — | — | — | — | — | — |
| Thickener | | | | | | | | | | | | | | | | | | |
| Gralaxy 1074 | — | — | — | — | — | — | — | — | — | — | 2 | — | — | — | — | — | — | — |

TABLE I-continued

| EXAMPLE | FOAMABLE MIXTURE FORMULATIONS 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Softener | | | | | | | | | | | | | | | | | | |
| Peem-410 | — | — | — | — | — | — | — | — | — | — | — | 20 | — | — | — | — | — | — |
| Pigment and/or Dye | | | | | | | | | | | | | | | | | | |
| Titanox RA-50 | — | — | — | — | — | — | — | — | — | — | — | — | — | — | 10 | — | — | — |
| Genacryl Brill. Yellow 10GF | — | — | — | — | — | — | — | — | — | — | — | — | 10 | — | — | — | — | — |
| Diluent | | | | | | | | | | | | | | | | | | |
| Water | 40 | 40 | 35 | 40 | 35 | 35 | 40 | 35 | 35 | 30 | 35 | 35 | 35 | 35 | 30 | 40 | 40 | 40 |
| Alcohol(isopropanol) | — | 5 | 5 | — | 5 | 5 | — | 5 | — | — | 5 | — | — | 5 | — | — | — | — |

The above mixtures in Table I are diluted with water and/or alcohol for the reason that they are subsequently combined with resins having relatively high solids (as shown in Table II). However, when a low solids resin, in a highly diluted state, is employed, the above mixtures need not include water.

EXAMPLES 19 THROUGH 40

The various resin and/or latex compositions, containing at least one of the foam aid formulations described in Table 1 are reported in following Table II. In each of the examples in Table II, 10 parts of Knightset accelerant M-4 is employed as a catalyst. The compositions are separated mixed and foamed in graduated glass beakers with a Hamilton Beach milk shaker under atomspheric pressure and at room temperature. The components of each example are mixed for a period of from 3 to 7 minutes at a speed such that vortexing of the composition occurs in the beaker. The resulting foamed compositions are then examined for texture and the volume increase is measured in CCS (cubic centimeters). A soft lather, of the consistency of face shaving foam is most desireable. Compositions having a liquid or watery consistency are unacceptable since they collapse or penetrate a fabric before uniform distribution can be achieved. After 2 minutes, the compositions in the beakers are immediately examined for drainage. Only those having zero percent drainage are acceptable.

Of the compositions outlined in Table II, Examples 19 through 35, 39 and 40 provide stable forms of excellent texture and possess high resin expansion as indicated by the foam level in % expansion. In regard to Examples 36, 37 and 38, these compositions are altogether unacceptable since they are watery and have substantially high drainage. The poor quality of compositions 36, 37 and 38 is due to the presence of Igepals and/or Emulphogene which destroy the stability of the compositions. Accordingly, the taurides and the nonsulfated ethylene oxide alcohols should be excluded as foaming agents in the present compositions.

When the foam aid formulations of either Example 7 or Example 10 are substituted for that of Example 2 in the composition of Example 19, the resulting foam levels, appearances and stabilities are the same as that reported for composition 19 in Table II.

TABLE II

| EXAMPLE | FOAM COMPOSITIONS 19 | 20 | 21 | 22 | 23 | 24 | 25 | 26 | 27 | 28 | 29 | 30 |
|---|---|---|---|---|---|---|---|---|---|---|---|---|
| Resin (Solids) | | | | | | | | | | | | |
| Aerotex M-3 (80%) | 100 | 100 | 100 | — | — | — | — | 100 | — | — | — | — |
| Cymel 303 (50%) | — | — | — | — | — | — | — | — | — | — | — | — |
| Permafresh 114 (42%) | — | — | — | 100 | — | — | — | — | — | — | — | — |
| Permafresh 184 (42%) | — | — | — | — | 100 | — | — | — | 100 | 100 | 100 | — |
| Permafresh 479 (36%) | — | — | — | — | — | 100 | — | — | — | — | — | — |
| Permafresh 183 (42%) | — | — | — | — | — | — | 100 | — | — | — | — | — |
| Geon latex 352 (55%) | — | — | — | — | — | — | — | — | — | — | — | 100* |
| Foam Formulation of: | | | | | | | | | | | | |
| Example 1 | — | — | — | — | — | — | — | — | 12 | — | — | — |
| Example 2 | 10 | — | — | — | — | — | 6 | — | — | — | — | — |
| Example 3 | — | 10 | — | — | — | — | 6 | — | — | — | — | — |
| Example 4 | — | — | — | — | — | — | — | — | — | 15 | — | — |
| Example 5 | — | — | — | — | — | — | — | — | — | — | 15 | — |
| Example 6 | — | — | 10 | 10 | 10 | 10 | — | 5 | — | — | — | — |
| Example 15 | — | — | — | — | — | — | — | — | — | — | — | 12 |
| Diluent - Water | 30 | 30 | 30 | — | — | — | — | 30 | 10 | 10 | — | 20 |
| Foam level | 500 | 600 | 600 | 550 | 600+ | 500 | 500 | 315 | 400+ | 400+ | 400+ | 500+ |
| Appearance (+ = lather; 0 = liquid) | + | + | + | + | + | + | + | + | + | + | + | + |
| 0% Drainage at 2 minutes | yes | yes | yes | yes | yes | yes | yes | yes | yes | yes | yes | yes |

| EXAMPLE | 31 | 32 | 33 | 34 | 35 | 36 | 37 | 38 | 39 | 40 |
|---|---|---|---|---|---|---|---|---|---|---|
| Resin (Solids) | | | | | | | | | | |
| Aerotex M-3 (80%) | — | 50 | — | — | — | 100 | 100 | 100 | — | — |
| Cymel 303 (50%) | — | 50 | — | — | — | — | — | — | — | — |
| Permafresh 114 (42%) | — | — | 100 | — | — | — | — | — | — | — |
| Permafresh 184 (42%) | 100 | — | — | — | — | — | — | — | 100 | 100 |
| Permafresh 479 (36%) | — | — | — | — | — | — | — | — | — | — |
| Permafresh 183 (42%) | — | — | — | 100 | — | — | — | — | — | — |
| Geon latex 576 (55%) | — | — | — | — | 100* | — | — | — | — | — |
| Foam Formulation of: | | | | | | | | | | |
| Example 8 | 11 | — | — | — | — | — | — | — | — | — |

TABLE II-continued

| | FOAM COMPOSITIONS | | | | | | | | | |
|---|---|---|---|---|---|---|---|---|---|---|
| Example 9 | — | 8 | — | — | 12 | — | — | — | — | — |
| Example 11 | — | — | — | — | — | — | — | — | 10 | — |
| Example 12 | — | — | 10 | — | — | — | — | — | — | — |
| Example 13 | — | — | — | — | — | — | — | — | — | 10 |
| Example 14 | — | — | — | 10 | — | — | — | — | — | — |
| Example 16 | — | — | — | — | — | 10 | — | — | — | — |
| Example 17 | — | — | — | — | — | — | 10 | — | — | — |
| Example 18 | — | — | — | — | — | — | — | 10 | — | — |
| Diluent - Water | 20 | 30 | 20 | — | 30 | 30 | 30 | 30 | — | — |
| Foam level | 400+ | 400+ | 400+ | 450+ | 450+ | 200 | 200 | 175 | 500+ | 500+ |
| Appearance (+ = lather; 0 = liquid) | + | + | + | + | + | 0 | 0 | 0 | + | + |
| 0% Drainage at 2 minutes | yes | yes | yes | yes | yes | no | no | no | yes | yes |

*Twenty parts of a phosphate plasticizer (Kronitex 100 supplied by FMC Corp.) and five parts of a detackifying agent (Nopco KO4, supplied by Nopco Chemical Co.) are added prior to foaming.

Surprisingly, the conventional foaming agents such as the taurides, i.e. the metal salts of taurine ($H_2N—C_2H_4—SO_3X$); the alkylphenoxy-polyethyleneoxy-alkanols, such as the Igepals or the alkoxy-polyethyleneoxy alkanols, such as Emulphogene DA 630 (tridecyloxy-polyethyleneoxy-ethanol), when added to the foamable mixtures of the present invention, destroy the stability of the resulting resin compositions so that they are unsuitable. Examples 36 and 37 in Table II illustrate this phenomenon.

Example 38 in Table II illustrates the unsatisfactory results obtained when the dispersant (element b) of the present foamable mixture is omitted.

The remaining foam compositions of Examples 19–35, 39 and 40 all possess high resin expansion, good stability and are soft, lathery foams, the latex foams of Examples 30 and 35 being somewhat more rigid.

Example 39 which incorporates the thickened foam, i.e. the formulation of Example 11, maintained stability for more than three hours. Example 40 which incorporates the pigmented foam, i.e. the formulation of Example 13, also provides extended stability. However, foam stability of more than a few minutes is not required when the foam is crushed, as in textile finishing, since in such cases padding by crushing the foam into the fiber immediately follows foam application to the textile.

The rate of application of the foamed compositions of Table II to a fabric in a finishing operation, including drying and curing steps to provide a finished product, is between about 40 to 80 yards or more of fabric per minute. The foamed compositions of Examples 30 and 40 when applied to a white silk fabric, are capable of simultaneously coloring and strengthening the fibers of the fabric at a rate of about 60 yards per minute.

EXAMPLE 41

The compositions of each of Examples 19 through 40 and additional compositions, substituting the foam aid formulations of examples 7 and 10 in composition 19 of Table II, are each separately applied to a woven cotton fabric, a knitted polyester fabric (KODEL) and to a woven polyacrylonitrile (ORLON) by the following technique. In each case, the fabric is placed on a feed belt of a pre-cast coater where it is carried past a foam feeder from which a foam coating of approximately 20 mils thickness is applied. The foam feeder is backed by a doctor blade for leveling and providing an even distribution of the foam on the surface of the fabric. In each case, a uniform foam thickness of 15 mils is leveled on the surface of the fabric employed. The fabric is then advanced through a padding device which comprises 2 rollers, each exerting an opposite pressure between about 20 psig and about 50 psig, e.g. 35 psig, between which the coated fabric is passed so that the foam on the fabric surface is crushed to between about 5 and about 20% of its original thickness, e.g. about 15% of its original thickness. In this way, the foam uniformly penetrates the fibers of the fabric. The fabric is then passed to a drying oven wherein, at a temperature between about 200° F. and about 390° F., preferably between about 230° F. and 320° F., for example 275° F., the fabric is dried. The drying operation is completed within a period of 2–8 minutes. The fabrics coated with the compositions in Table II, except for Example 30 and Example 35 are dried within 2 minutes. In the case of Examples 30 and 35, a somewhat extended curing time for plasticizing to take place in the latex (GEON 576) is recommended, e.g. a curing time of about 7 minutes.

The fabrics finished with the foam compositions of Table II exhibit greatly improved strength, soft and pliable hand and resistance to wear or abrasion.

EXAMPLE 42

The present foam aid formulation was tested in the sizing textile yarn by combining WD size, an anionic modified polyester, supplied by Eastman Chemical Products, Inc. with the foam composition of Example 23, having incorporated therein the foam aid formulation of Example 6. After the components are uniformly mixed and foamed, the foam is applied to a woven textile yarn by passing the yarn through a foam reservoir and then between rollers for crushing the foam into the fiber, as set forth in Example 41. The yarn is then dried in an oven maintained at about 250° F. for a period of 5 minutes, after which it is removed and found to have at least 25% increased strength and resistance to abrasion.

Equally beneficial results are obtained when paper is substituted for the yarn; however, in this case, drying temperatures are maintained at about 200° F. the treated paper product showed increased smoothness and strength. Alternatively, the size composition may be incorporated in paper manufacture by adding the foamed size to the beaker or refiner or both during the blending of the paper pulp. In this way, a large variety of specialty papers can be produced by varying the additives in the foam compositions.

Generally, the processing of paper involves a foam bath of the size-containing formulation through which the paper passes, followed by one or a series of squeezing rolls to remove excess foam, and heated drying rolls for fixing the size coated paper to produce a finished paper product. These and other applications of the foam compositions of the present invention, such as sizing of leather and other fabrics or yarns, will become apparent from this disclosure.

In the compositions of this example, between about 5 and about 15 parts of instant foam aid formulation is mixed with 100 parts of the size. In the case of the wool yarn, 100 grams of WD size is mixed with 10 grams of the foam aid formulation of Example 6; whereas in the case of paper, 100 grams of WD size is mixed with 6 grams of the foam formulation of Example 6. These components are mixed and foamed to a lathery foam level of 500 mls. The resulting stable foam is then fed to a reservoir from which it is applied to the yarn as described above. A second mixture incorporating 100 grams of WD size, 10 grams of foam aid formulation 6 and 1 gram of Disperse Yellow 67 dye was mixed and foamed and the resulting foam composition similarly applied to a light wool yarn in the manner described above. The dried yarn had a uniform bright yellow color and increased strength and resistance to abrasion.

EXAMPLE 43

The foam aid formulations of Example 6 (1 part) was mixed and foamed with 1 part AFTUSOL red dye, C.I. Red 79, and 10 parts of NEODOL 25-3A. The components of this formulation were mixed and foamed to a lather having a foam level of 700 ccs. The resulting stable foam was then uniformly applied to the surface of a white silk fabric as described above in the application of the Table II foam composition to fabrics. The resulting dried silk textile was uniformly dyed a brilliant red while showing greatly increased strength and soft hand.

In the above Examples, it is to be understood that any of the aforedesignated additives, as well as conventional binders and/or lubricants, can be substituted for, or added to either the foam aid formulations or the foam compositions set forth in Examples 1 through 15 and 19 through 35, 39 and 40. It is also to be understood that any of the aforedesignated foaming agents, stabilizers, and/or dispersants, as well as any of the aforementioned resins can be substituted in said Examples to provide foam compositions which impart increased strength, good hand, uniform dyeing and finishing, fire resistance and other particular beneficial properties imparted by the additive components.

In addition to the above finishing, coating and dyeing of textiles and paper, the resin foam compositions of this invention can be formulated with the same or other latexes, resins and plastics mentioned hereinabove by substitution in any of Examples 19–35, 39 and 40, to coat carpets and rugs as backings, to provide self-laminatable surfaces, washable wall coverings and flock adhesives, fabric laminating adhesives, acoustic tiles, dirt resistant and/or flame resistant products such as rigid structural panels, drapries, upholstery, etc. other uses, as will become apparent from the foregoing description and disclosure.

What is claimed is:

1. A foamable composition comprising from about 50 to about 70 parts by weight of a coating agent selected from resins, plastics and latexes; and from about 2 to about 8 parts by weight of an acid type catalyst; from about 5 to about 14 parts by weight of the expansion mixture for foaming resin, latex and plastic coatings which comprises a foamable mixture of:

(a) 15 to 53 weight % of a compound having the formulae:

$$R{-}(OCH_2CH_2)_nOSO_3H^-M^+$$

and/or $$R^1{-}(CH_2CH_2O)_{n+1}SO_3H^-M^+$$

wherein R is alkyl of 6 to 18 carbon atoms or hydroxyalkyl of 6 to 18 carbon atoms; $R^1$ is hydrogen, alkyl of 6 to 18 carbon atoms or phenoxy substituted with not more than two alkyl groups each having 1 to 23 carbon atoms; n is an integer having a value of 0 to 10; and M is sodium, potassium, calcium, ammonium or an alkyl- or alkyloxy- amine radical of 1 to 6 carbon atoms;

(b) 5 to 42 weight % of a compound having the formulae:

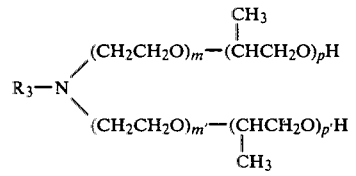

and/or

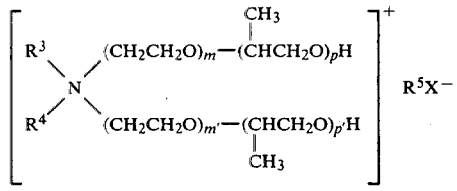

wherein $R^3$ is alkyl of 6 to 20 carbon atoms; $R^4$ and $R^5$ are independently alkyl of 1 to 4 carbon atoms; X is sulfate, halide or phosphate; m and m' are integers independently having a value of 4 to 30; and p and p' are integers independently having a value of 0 to 20; and (c) 5 to 45 weight % of a compound having the formula:

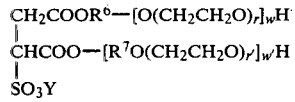

wherein $R^6$ and $R^7$ are independently alkylene of 4 to 22 carbon atoms; r and r' are independently integers each having a value of 0 to 15; w and w' are integers independently having a value of 0 or 1; and y is sodium or potassium; and from about 2 to about 26 parts of water per part of coating agent.

2. The composition of claim 1 wherein the expansion mixture comprises from about 30 to about 50 weight % (a), from about 21 to about 30 weight % (b) and from about 20 to about 45 weight % (c).

3. The composition of claim 1 wherein component (a) is sodium sulfate.

4. The composition of claim 1 wherein component (a) is the ammonium salt of decyl-polyethyleneoxysulfate.

5. The composition of claim 1 wherein component (a) is the ammonium salt of nonylphenoxy-polyethyleneoxysulfate.

6. The composition of claim 1 wherein component (b) is a mixture of quaternized $C_8$ to $C_{24}$ alkyl bis(polyethyleneoxyethanol) amine salts.

7. The composition of claim 1 wherein component (b) is a mixture of $C_6$ to $C_{20}$ alkyl bis(polyethyleneoxypolyisopropyleneoxyethanol) amines.

8. The composition of claim 1 wherein component (b) is a mixture of quaternized dibutyl bis(polyethyleneoxypolyisopropyleneoxyethanol) amine ethylphosphate.

9. The composition of claim 1 wherein component (c) is the sodium salt of decylsulfosuccinate.

10. The composition of claim 1 wherein component (c) is the sodium salt of dioctylsulfosuccinate.

11. The composition of claim 1 wherein component (c) is the sodium salt of butoxy-polyethyleneoxyethanolsulfosuccinate.

12. The composition of claim 1 which additionally contains between about 1 and about 25 parts of an additive selected from the group of a softener, a foam booster, a flame retardant, a plasticizer, a pH adjuster, a coloring agent, a brightner, a UV absorber, a stabilizer, a wetting agent, a dispersing agent, an antistat, a thickener, and a heat sensitizer.

13. The composition of claim 12 wherein the composition contains a thickener guar gum.

14. The composition of claim 12 which contains titanium oxide as a coloring agent.

15. The composition of claim 12 which contains a Genacryl dye as a coloring agent.

16. The composition of claim 12 which contains a disperse dye as a coloring agent.

17. The composition of claim 12 which contains a polyester sizing agent having a pH of 6–8 and a viscosity at 24° C. of 35 cp.

* * * * *